United States Patent [19]

Gueret

[11] Patent Number: 4,887,745

[45] Date of Patent: Dec. 19, 1989

[54] CONTAINER COMPRISING A NECK AND A CAP WHICH CAN BE MANIPULATED WITH ONLY ONE HAND

[75] Inventor: Jean-Louis Gueret, Paris, France

[73] Assignee: L'Oreal, Paris, France

[21] Appl. No.: 239,751

[22] Filed: Sep. 2, 1988

Related U.S. Application Data

[62] Division of Ser. No. 69,964, Jul. 6, 1987, Pat. No. 4,807,786.

[30] Foreign Application Priority Data

Jul. 7, 1986 [FR] France ..... 86 09827
Nov. 18, 1986 [FR] France ..... 86 15991

[51] Int. Cl.[4] ..... B65D 5/72

[52] U.S. Cl. ..... 222/499; 222/522; 222/559

[58] Field of Search ..... 222/499, 522, 523, 559, 222/562, 544, 519, 153, 542

[56] References Cited

U.S. PATENT DOCUMENTS 1,970,505 8/1934 Parkin ..... 222/499
4,424,918 1/1984 Stall ..... 222/153

FOREIGN PATENT DOCUMENTS 2593145 1/1986 France .

*Primary Examiner*—Joseph J. Rolla
*Assistant Examiner*—Kenneth Noland
*Attorney, Agent, or Firm*—Cushman, Darby & Cushman

[57] ABSTRACT

This container comprises a body delimited by a wall; a neck surmounting the body and terminated in a substantially cylindrical spout; and a cap which can be manipulated with only one hand and which includes by a top carrying an extension. A provision for retaining the cap on the container comprises a sleeve interlocked with the cap and secured to the container neck. The extension and the sleeve further include cooperating structure to ensure the displacement of the cap in relation to the container, the structure including two pushing elements, accessible from outside the container and arranged substantially symmetrical in relation to the spout, the pushing elements being movable in relation to an axis of flexure substantially parallel to the top panel of the cap to slidably engage inclined ramps on the cap extension which serve as bearing surfaces for the pushing devices when they are actuated so as to displace the cap from a closed position thereby permitting the container's contents to be discharged.

11 Claims, 10 Drawing Sheets

CONTAINER COMPRISING A NECK AND A CAP WHICH CAN BE MANIPULATED WITH ONLY ONE HAND

This is a division of application Ser. No. 069,964 filed July 6, 1987, now U.S. Pat. No. 4,807,786.

FIELD OF THE INVENTION

The present invention relates to a container comprising a body surmounted by a neck and a cap which is disposed on this neck to close this container and which can be handled with only one hand to eliminate this closure.

PRIOR ART

Containers comprising a body surmounted by a neck are provided with various closure devices determined in particular by (a) the type of product contained in the container, (b) the necessary and/or desired seal, (c) the cost of manufacture and/or (d) the desired period of preservation.

Most, if not practically all, of the closure devices presently used, require the user to have both hands free to open the container.

French patent application No. 86 00612 discloses a container comprising a body and a detachable cap which the user can remove and replace using only one hand. This container comprises a body surmounted by a neck which includes a fastening flange, or a circular groove, cooperating with two catches carried by a substantially oval and elastic ring; this ring comprises two push buttons projecting from two openings arranged in the lateral skirt of the cap with which the cap is integral; the above mentioned catches are disposed near the ends of the minor axis of the oval constituted by the ring, and the push buttons are disposed near the ends of the major axis of this same oval. The cap is made of a rigid material and does not itself comprise the means for detaching it from the container, these being instead constituted by the ring. Such a device, whilst certainly worthwhile, is not always satisfactory and cannot be used for every type of container, in particular those where the opening is to be freed without the cap being withdrawn.

OBJECTS OF THE INVENTION

It is an object of the present invention to provide a container comprising a body provided with a neck with a cap which the user need handle with only one hand, either in order to remove it, or only to free the opening of the container.

Another object of the present invention is to provide a container of the above mentioned type which saves the user from making any splashes during the opening.

An additional object of the present invention is to provide such a container whose cost of manufacture remains competitive in relation to the known containers because of the very fact that it no longer comprises any unscrewing means.

Yet another object of the present invention is to provide a container of the above mentioned type capable of being used not only for a substantially cylindrical container with a substantially axial opening, but also for a non-cylindrical container, and/or a container with a lateral opening.

Yet another object of the present invention is to provide a container of the above mentioned type which offers hygienic conditions of use.

SUMMARY OF THE INVENTION

These objects, as well as others which will become apparent below are attained by a container comprising firstly a body delimited by a wall; secondly a neck surmounting this body and terminating in a substantially cylindrical spout which is provided with at least one fastening flange; and thirdly a cap, which can be handled with only one hand, constituted by a top panel carrying a lateral extension; characterised in that it comprises means for retaining the cap on the container which comprise fixing means cooperating with the fastening flange of the neck; and in that the lateral extension comprises first means capable of cooperating with second means carried by the spout to ensure (i) the displacement of the cap in relation to the neck, and (ii) the opening of the container, some of these first and second means being constituted by two pushing means accessible from outside, substantially symmetrical in relation to the spout, and movable in relation to an axis of flexure substantially parallel to the top of the said cap, whilst the other means are constituted by at least one sloping ramp serving as bearing surface for said pushing means when they are actuated.

In accordance with a first aspect of the invention, the means for retaining the cap are carried by the top, and are substantially perpendicular to said top panel and symmetrically in relation to the cap axis, the fixing means being constituted by at least one end projection of the said top panel and the lateral extension being constituted by a lateral skirt comprising the two pushing means, and the neck comprises an annulus substantially coaxial with the spout and whose cross section decreases towards the top of the neck and whose cross section through a plane passing through the axis is a curve where at least one portion comprises a tangent sloping in relation to the axis so as to constitute the at least one ramp, intended to cooperate with the pushing means in order to cause said at least one projection to pass over said fastening flange with which it (they) cooperate(s) when the cap is pushed down on the neck so as to close the spout.

Advantageously, this annulus is a body of revolution arund the neck axis and, more particularly, substantially frustoconical.

Preferably, the annulus is situated on the neck below the at least one fastening flange; in that case, the annulus may be constituted by the shoulder joining the body to the spout. According to a variant of the embodiment, the annulus is situated on the spout above said at least one fastening flange.

In accordance with a first aspect of this embodiment the fixing means of the top of the cap is preferably constituted by two tabs each terminated by an end projection. According to a second example of this embodiment, it is advantageously constituted by the lateral skirt of the cap whose free edge comprises an annular projection on its internal surface.

In a first variant of the above mentioned first aspect of the invention, the or each pushing means is constituted by a flexible tongue cut out in the skirt with which it is integral at one of its sides, or axes of flexure, the opposite side to this axis of flexure, called the free end, cooperating with the annulus.

In a second mode of embodiment of the invention according to the above mentioned first aspect, each pushing means is constituted by a tongue integral at its axis of flexure with a circular element which is itself rendered integral with the cap whose lateral skirt comprises openings at the level of the free end of each tongue. These openings cut in the lateral skirt of the cap according to a first variant, entirely contain the tongues whose free end is constituted by a pallet which comprises on its face turned towards the spout, a catch cooperating with the annulus; the circular element is advantageously catch engaged on the free edge of the lateral skirt of the cap or covering the top panel of the cap. According to a second variant, the tongues whose free end is constituted by a pallet are disposed within the cap; the circular element is, in this case, a ring catch engaged opposite the lateral skirt at the periphery of the top panel of the cap; each tongue on its opposite side to the spout comprises an extra thickness so as to be at least co-planar with the lateral skirt of the cap.

According to a particular mode of embodiment of the invention, the spout comprises two attachment flanges which between them delimit a groove, the projections of the fixing means being disposed beneath the one which is remoter from the top of the spout when the cap obturates the spout, and in the groove after action on the pushing means.

Advantageously, the top panel of the cap comprises sealing means cooperating with the spout. These sealing means are for instance constituted by a sealing skirt.

Preferably, the container comprises in this mode of embodiment an obturator rendered integral with the top of the spout by any suitable means and cooperating with these sealing means.

Advantageously, the obturator comprises at its top a plurality of openings around a bulb, the top panel of the cap comprising an opening wherein this bulb comes to be accommodated when the cap is lowered on the spout.

Preferably, the pushing means and the projections of the retaining means are disposed in relation to the spout along one and the same diameter. The latter can also be disposed in relation to the spout along two substantially perpendicular diameters. Finally, the container according to this first aspect of the invention can also comprise a cover cap covering the cap and provided with openings making it possible to act on the pushing means.

According to a second aspect of the invention, the retaining means holding the cap on the container are constituted by an element surrounding the cap, the wall of the said element being traversed by the pushing means, the top of the cap comprising sealing means for the spout which can slide along the sides of the said spout, an opening being arranged in the sealing means and being obturated by the wall of the spout when the cap is pushed down on the neck in the closed position, and the said opening being freed by a translation of the cap under the action of the pushing means for feeding a lateral duct which ensures the emergence of the product contained in the container.

In accordance with a first mode of embodiment, according to this second aspect of the invention, the extension is constituted by a lateral skirt of the top panel which comprises the two pushing means, two sloping ramps being associated with each one of the latter which are formed in a shoulder joining the neck to the body.

In accordance with a second mode of embodiment, according to this second aspect of the invention, the pushing means are carried by the element ensuring the hold of the cap on the body, two sloping ramps being associated with each one of the latter which are formed in a lateral extension element carried by the top panel of the cap.

Advantageously, each pushing means is constituted by a flexible tab attached to the element wherewith it is integral at its axis of flexure, the side opposed to this axis of flexure constituting a free end which cooperates with a corresponding ramp. The ramps are in particular inclined planes.

According to a first variant, the sealing means of the spout are constituted by two coaxial skirts, namely an internal skirt disposed substantially against the internal wall of the spout and an external skirt disposed substantially along the external wall of the spout, the said external skirt comprising the opening connected to the lateral duct. This duct is advantageously adjacent to the top panel of the cap.

According to a second variant, the sealing means for the spout are constituted by an axial skirt comprising the opening connected to the lateral duct disposed between the duct of an adaptor whose free edge is folded twice over on itself to constitute an intermediate annular zone for receiving the said skirt and an external annular zone for fastening on the spout.

Provision is advantageously made for limiting the travel of the cap in relation to the container in the opening direction.

In accordance with the above mentioned first mode of embodiment, the element for retaining the cap can be constituted by a cover cap comprising a lateral skirt provided with fastening means on the neck so as to render it integral therewith, the upper edge of the lateral skirt carrying a rim forming a stop for limiting the travel of the said cap in relation to the cover cap in the opening direction, the said lateral skirt comprising an opening opposite each tab in such a way that each one of the latter can project from the corresponding opening. The cap may comprise a shoulder coming to bear against the rim of the cover cap when the cap is in the open position.

In accordance with the above mentioned second mode of embodiment, the retaining element of the cap can be constituted by a sleeve provided with fastening means on the neck so as to render it integral therewith, the said sleeve surrounding a peripheral skirt of the cap, the said cap comprising means for fastening the cap on the sleeve in the closed position of the container; provision may then be made for an adaptor on the neck such as defined above whose conduit comprises an external bead serving as stop for an internal bead of the sealing skirt of the cap, to limit the travel of this latter in relation to the container.

Advantageously, the neck comprises a first fastening flange which cooperates with an adaptor extending the spout, for instance such as the one described above, and a second fastening flange which cooperates with the fixing means of the cover cap or of the sleeve. Preferably, the fixing means of the cap are situated near the edge of its lateral skirt which is near the body of the container.

In accordance with a preferred mode of embodiment, the container has a non-circular cross section, for instance, a substantially elliptical one; advantageously the pushing means and the ramps are substantially disposed opposite the ends of the major axis of the ellipse and the fixing means of the cover cap or of the sleeve substantially opposite the ends of the minor axis of the ellipse.

The cover cap or the ring comprises at the level of the fixing means and on either side of the latter, stops which bear on plates arranged on the neck.

BRIEF DESCRIPTION OF THE DRAWINGS

To render the object of the present invention more readily understood there will now be described four embodiments represented in the attached drawings by way of purely illustrative and non-restrictive examples.

In these drawings.

DESCRIPTION OF THE PREFERRED EMBODIMENTS

Figure 1:
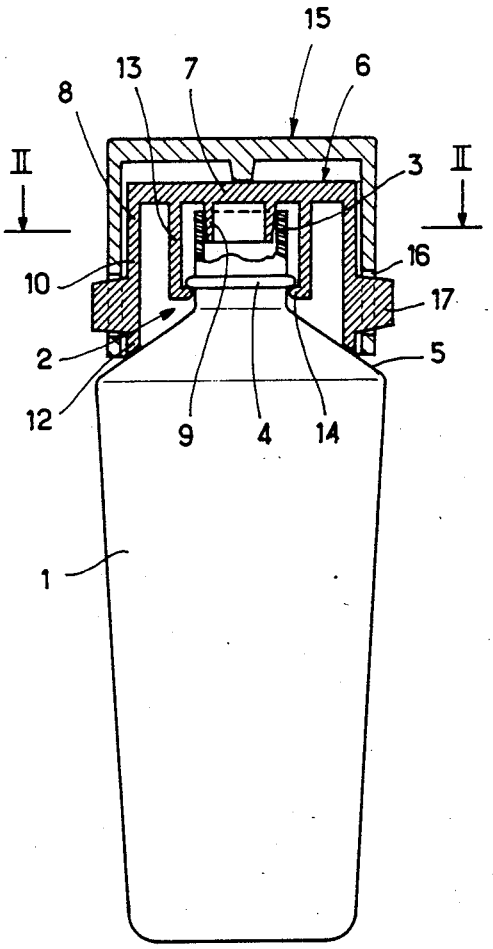
FIG. 1 is a vertical cross-section, along the line I—I of FIG. 2 of a container in accordance with a first embodiment of the present invention, when the cap which it comprises closes its body.
Figure 3:
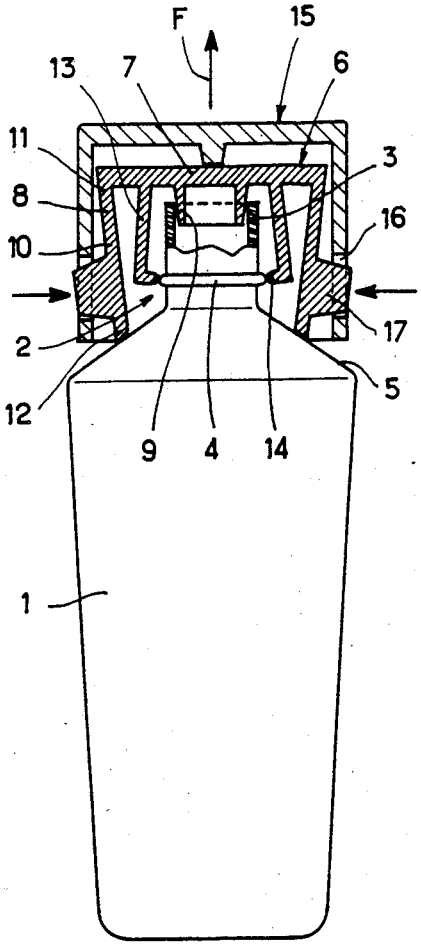
FIG. 3 corresponds to FIG. 1 when the cap is being manipulated with a view to being removed.
Figure 2:
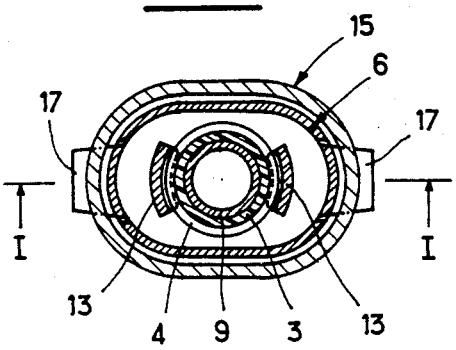
FIG. 2 is a cross section along the line II—II of FIG. 1.

As may be seen in FIGS. 1 to 3, which relate to a first embodiment of the present invention, a container comprises, according to the present invention, firstly a body delimited by a wall, secondly a neck 2 surmounting this body 1 and constituted by a substantially cylindrical spout 3 which is provided with a fastening flange 4 and a shoulder 5 joining this spout 3 to the body 1, and thirdly a cap 6 which can be manipulated with only one hand which is disposed on the spout 3 in a detachable manner. This cap 6 is constituted by a top panel 7 extended by a lateral skirt 8.

The top panel 7 of the cap 6 generally comprises a sealing skirt 9 which cooperates with the interior of the spout 3 so that the product contained in the body 1 should not escape when the cap 6 is in the closed position, that is to say, pushed down on the spout 3. The cap 6 comprises two pushing means which are constituted by two flexible tongues 10, cut out in its lateral skirt 8: these tongues 10 remain integral with the lateral skirt at an end termed the axis of flexure 11 which is parallel to the top panel 7 of this cap 6 and is situated near this top panel 7. The end of this tongue 10 which is remote from the axis of flexure 11 is called the free end 12: in this example of the embodiment, the axis of flexure 1 is situated vertically above the free end 12 of the tongues 10.

The top panel 7 of the cap 6 comprises a fixing means which is constituted by two tabs 13 substantially perpendicular to the said top panel and symmetrical in relation to the axis of the cap 6; these tabs 13 each terminate in a projection 14 cooperating with the fastening flange 4. When the cap 6 is in the closed position, each projection 4 is situated below this fastening flange 4.

The neck 2 comprises a frustoconical annulus coaxial with the spout 3 and whose diameter decreases towards the top of the neck; this annulus is, in this first example of the embodiment, constituted by the shoulder 5 which joins the body 1 to the spout 3.

When one wishes to open such a container, that is to say, to remove the cap 6, it suffices for the user to depress the tongues 10 with two fingers of the same hand: the free ends 12 of the tongues come into contact with the shoulder 5 which forms a ramp inclined towards the top of the spout 3. Because of this, an axial force F is applied by the user, as represented in FIG. 3, which is sufficient for the projections 14 of the tabs 13 to pass over the flange 4: the cap 6 can then be removed.

To replace the cap 6, it suffices to force it on to the neck 2, until the projections 14 of the tabs 13 pass below the flange 4.

The container in accordance with this embodiment comprises a cover cap 15 which covers the cap 6 and which comprises openings 16 through which there projects an extra thick portion 17 of each tongue 10 provided at this level: by pressing on these extra thick portions 17, the user can thus act on the tongues 10.

Figure 4:
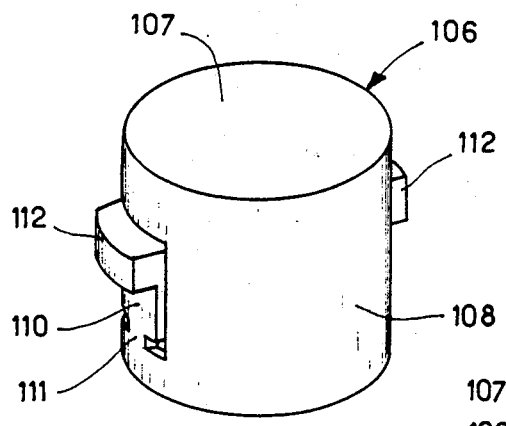
FIG. 4 is an external view of a cap according to a variant of this first embodiment of the invention.
Figure 5:
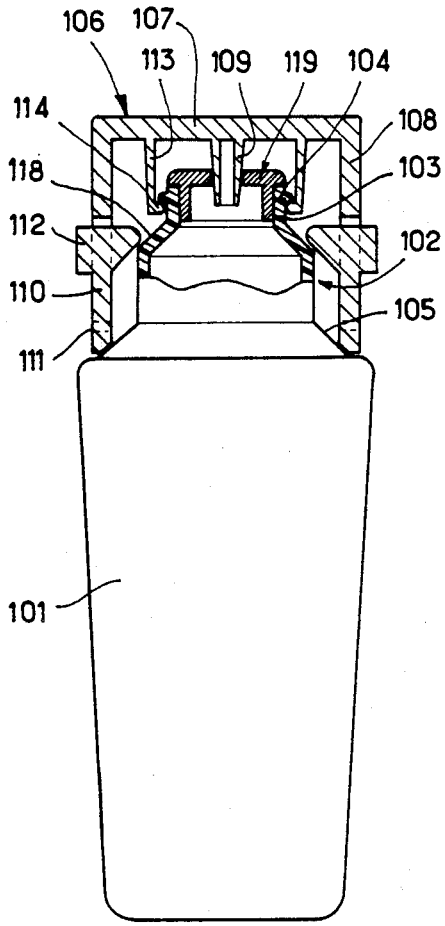
FIG. 5 is a vertical cross-section representing the positioning of this cap when it closes the container body.
Figure 6:
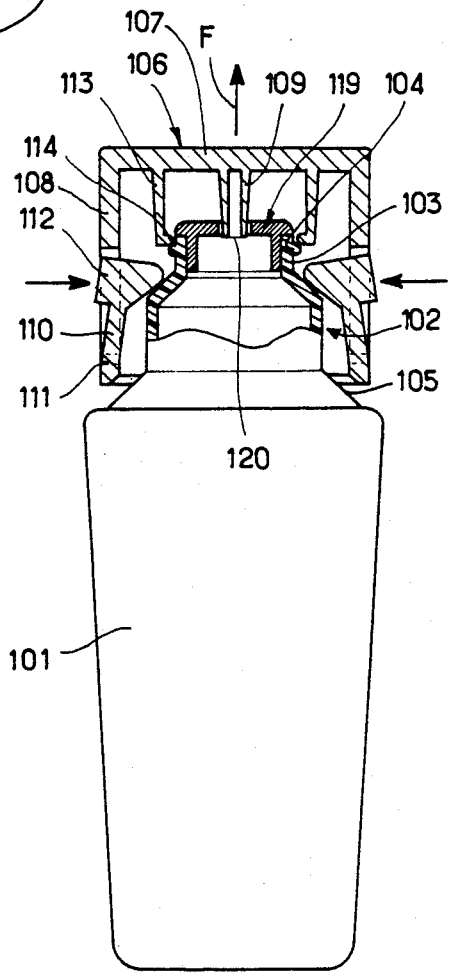
FIG. 6 corresponds to FIG. 5 when the cap is being manipulated with a view to being removed.

FIGS. 4 to 6 relate to a variant of this first embodiment; the elements corresponding to those represented in FIGS. 1 to 3 bear the same reference numerals increased by 100.

The cap 106 comprises two flexible tongues 110 in its lateral skirt 108: at one side these tongues 110 remain integral with the lateral skirt 108 at the axis of flexure 111 which is parallel to the top panel 107 of this cap 106 and which is situated below the free ends 112 of the tongues 110. In other words, the free end 112 of each tongue 110 is situated nearest the top panel 107 whilst the axis of flexure 111 is near the shoulder 105 joining the spout 103 to the body 101 of the container.

The neck 102 comprises a frustoconical ring 118 coaxial with the spout 103 and whose diameter diminishes towards the top of this spout 103; this annulus 118 is situated on the spout 103 in the vicinity of the free ends 112 so as to be able to cooperate with them. The fastening flange 104 is situated between the annulus 118 and the top of the spout 103.

Exactly as before, by pressing on the tongues 110 at the level of the free ends 112, the user causes the tongues to be displaced on the annulus 118 forming a ramp inclined towards the top of the spout which creates a sufficient force for the projections 114 of the tabs 113 to pass over the flange 104: the cap 106 can thus be removed.

As represented in FIGS. 5 and 6 the container comprises an obturator 119 which is mounted on the top of the spout 103 by any suitable means: the central opening 120 of this obturator 119 is obturated by the sealing skirt 109 of the cap 106.

Figure 7:
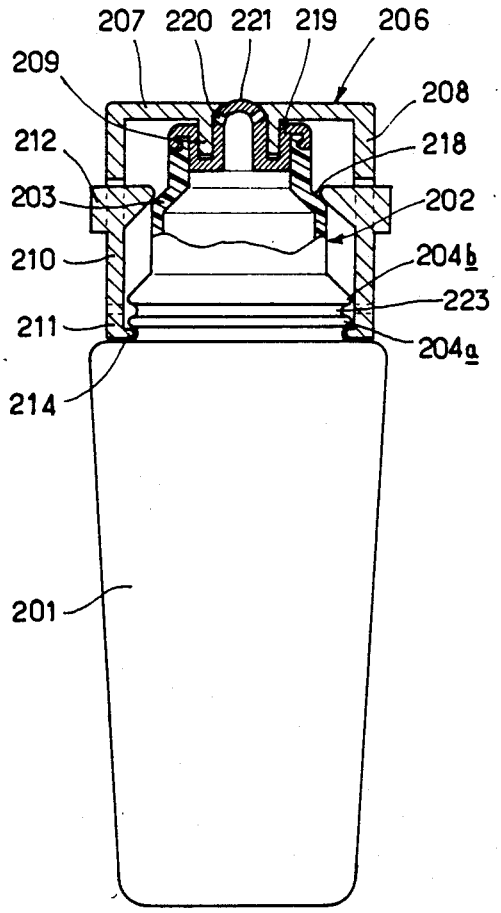
FIG. 7 represents a cap, in a vertical cross-section which is identical with that of FIG. 4, but for a container comprising an opening with a bulb.
Figure 8:
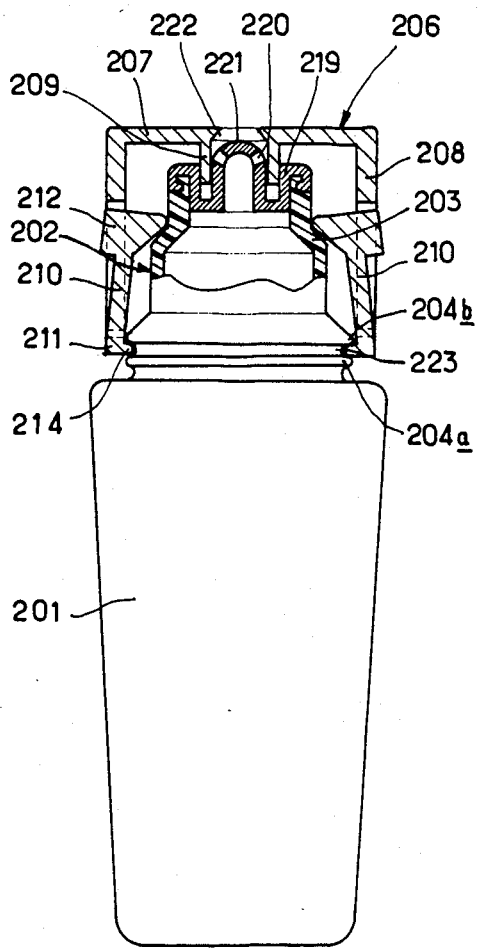
FIG. 8 corresponds to FIG. 7 when this cap is being manipulated with a view to freeing the opening with the bulb.

In FIGS. 7 and 8 there is represented a third variant of this first embodiment: the elements corresponding to those of FIGS. 1 to 3 bear the same reference numerals but increased by 200.

In this third variant, the container comprises an obturator 219 cooperating with the sealing skirt 209 whose top comprises a plurality of openings 220 arranged around a plate or bulb 221.

In this case, the top panel 207 of the cap 206 comprises an opening 222 in which this bulb 221 becomes accommodated when the cap 206 is pushed down on to the spout 203. In this embodiment, all that is necessary is to free the openings 220 which in no way requires total withdrawal of the cap 206.

In this variant, the neck 202 comprises two fastening flanges **204*a* and 204*b* which are situated near the base of the spout 203: the two fastening flanges 204*a* and 204*b* delimit between them a groove 223. As for the annulus 218, it is frustoconical and situated on the spout 203 between the fastening flanges 204*a* and 204*b* and the top of the spout 203. The tongues 210 each have their axis of flexure 211 situated below their end 212 just as in the example of the embodiment represented in FIGS. 5 and 6**.

As for the fixing means comprised by the top, it is constituted by the lateral skirt 208 the interior of whose free end is provided with an annular projection 214.

When the cap 206 is pushed down on the spout 203 in such a way that the openings 220 are obturated by the sealing skirt 209, the annular projection 214 is situated below the fastening flange **204*a*, that is to say, the one which is more remote from the top of the spout 203**.

When such a container is to be opened, that is to say, the opening 220 is to be freed in order to allow the product contained in the body 201 to escape towards the outside, the tongues 210 are pressed inwardly to cause their ends 212 to slide over the inclined surface of the annulus 218 towards the top of the spout 203, thus creating a force which causes the annular projection 214 to pass above the flange **204*a***.

Because of the short length of the annulus 218, the annular projection 214 remains wedged between the two flanges **204*a* and 204*b* in the groove 223: this allows the dispensing openings 220 to be freed but does not in any way allow the cap 206** to be withdrawn.

Figure 9:
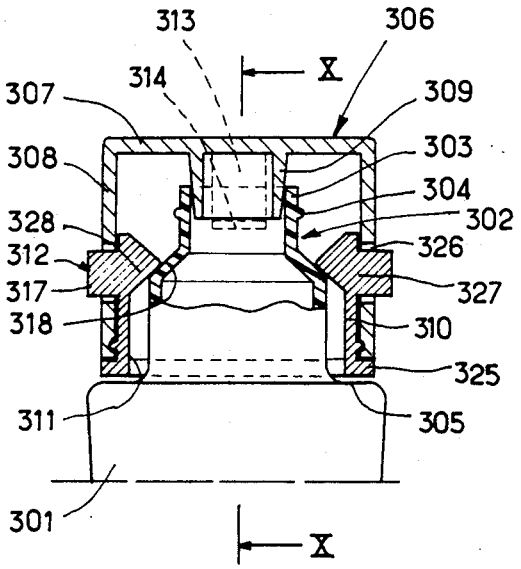
FIG. 9 is a vertical cross-section along the line IX—IX of FIG. 10 of a first variant of a second embodiment of the invention.
Figure 10:
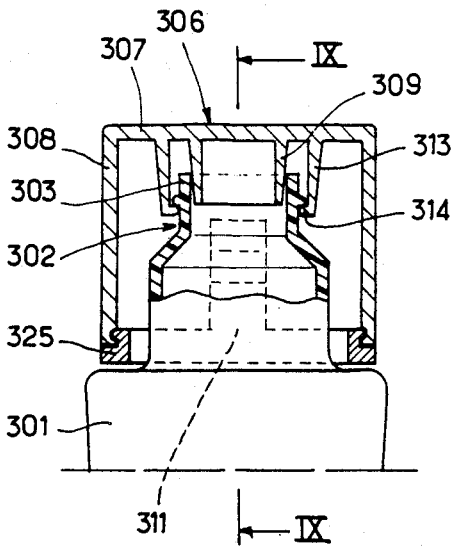
FIG. 10 is a vertical cross-section along the line X—X of FIG. 9.

FIGS. 9 and 10 relate to a second embodiment of the present invention wherein the pushing means are independent of the cap itself.

A container in accordance with this second embodiment comprises, firstly a body 301 delimited by a wall and secondly a neck 302 surmounting this body 301 and constituted by a substantially cylindrical spout 303, provided with a fastening flange 304 and a shoulder 305 joining the base of the spout 303 to the wall of the body 301 and thirdly a cap 306 which can be manipulated with one hand which is disposed on the neck 302 in a detachable manner. This cap 306 is constituted by a top 307 extended by a lateral skirt 308.

The top 307 of the cap 306 comprises a sealing skirt 309 which cooperates with the interior of the spout 303 so that the product contained in the body 301 does not escape therefrom when the cap 306 is in the closed position, that is to say pushed down on the spout 303.

According to this embodiment, the pushing means are each constituted by a tongue 310 integral at its axis of flexure 311 with a circular element 325 which in this embodiment, is a ring. This ring is itself attached to the cap 306 whose lateral skirt 308 comprises openings 36 in the vicinity of the free end 313 of each tongue 310.

The top panel 307 of the cap 306 also comprises two tabs 313 substantially perpendicular to the top panel and which are disposed on either side of the spout 303. Each tab 313 terminates in a projection 314 which cooperates with the fastening flange 304. When the cap 306 is in the closed position, each projection 314 is situated below the fastening flange 304.

As represented in FIGS. 9 and 10, the circular element 325 is catch-engaged on the free edge of the lateral skirt 308 and the tongues 310 are situated inside the cap 306. Each tongue 310 comprises, towards its free end 312, a pallet 327 whose face turned towards the spout 303 comprises a catch 328 which cooperates with the annulus 318; each pallet 327 has an extra thick portion 317 projecting through the corresponding opening 326 in such a way that the user may press on it to allow the projections 314 to be released from the tabs 313 of the fastening flange 304, as indicated above.

The circular element 325 can also be disposed against the top panel 307 of the cap 306.

Figure 11:
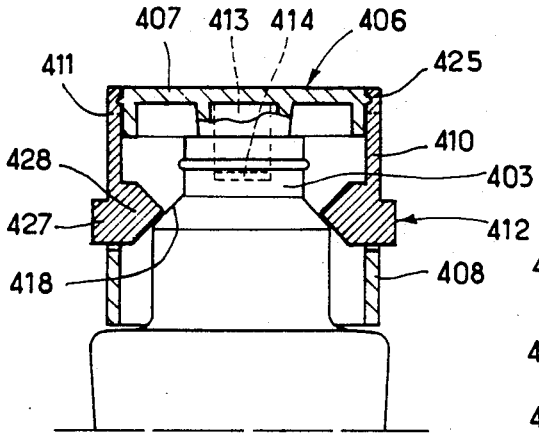
FIG. 11 is a vertical cross-section of a second variant of this second embodiment of the present invention.
Figure 12:
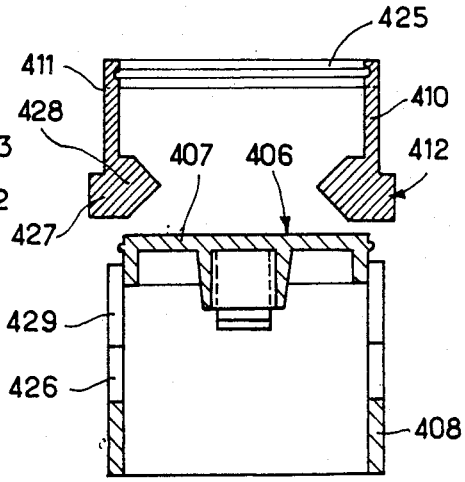
FIG. 12 is an exploded view of the cap of FIG. 11.
Figure 13:
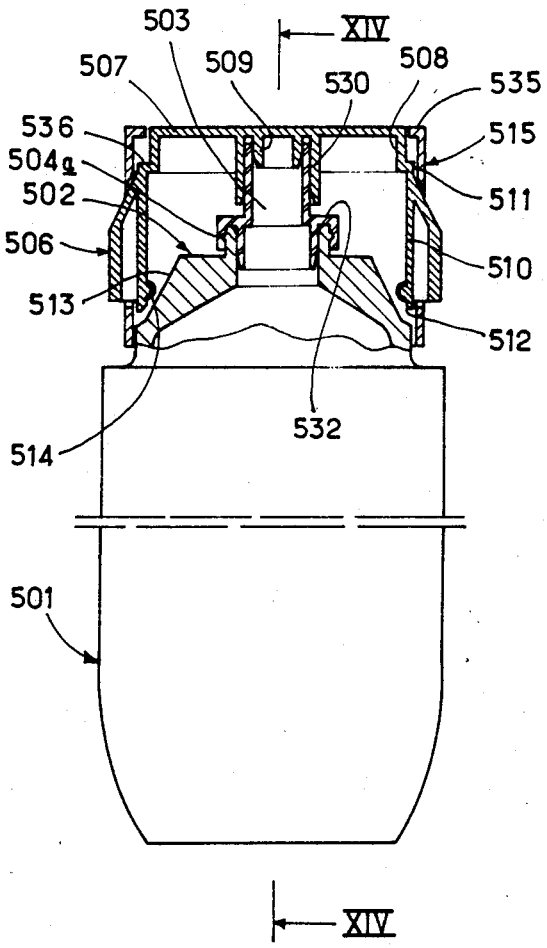
FIG. 13 shows a third embodiment of container according to the present invention, whose cross-section is an ellipse, in the form of a cross-sectional view along the major axis of this ellipse, said container being in the closed position.
Figure 14:
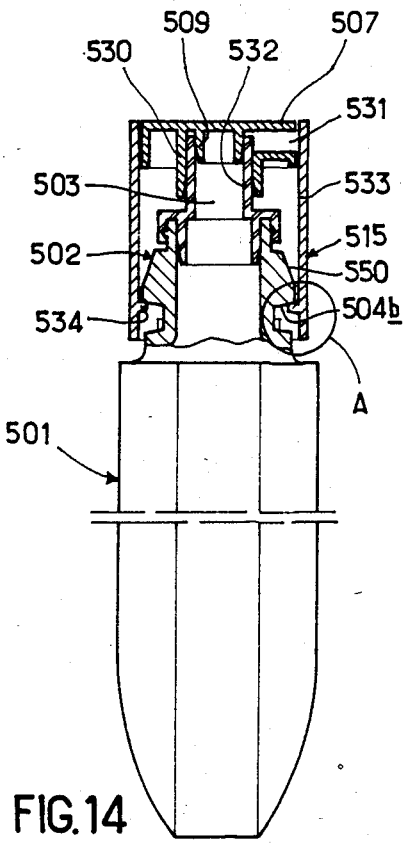
FIG. 14 is a cross-sectional view of the container of FIG. 13, taken along the line XIV—XIV of FIG. 13.
Figure 16:
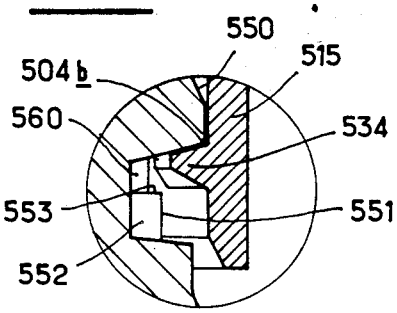
FIG. 16 is a view, on an enlarged scale, of detail A of FIG. 14.
Figure 15:
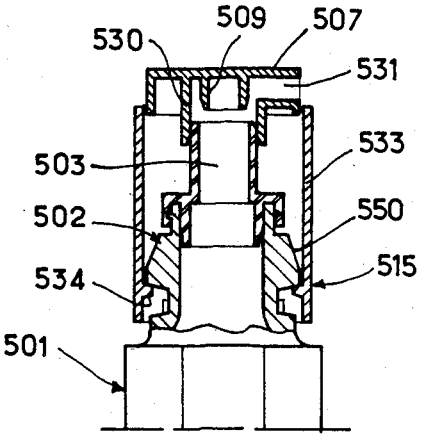
FIG. 15 represents the cross-section of FIG. 14 when the opening of the container is freed.
Figure 17:
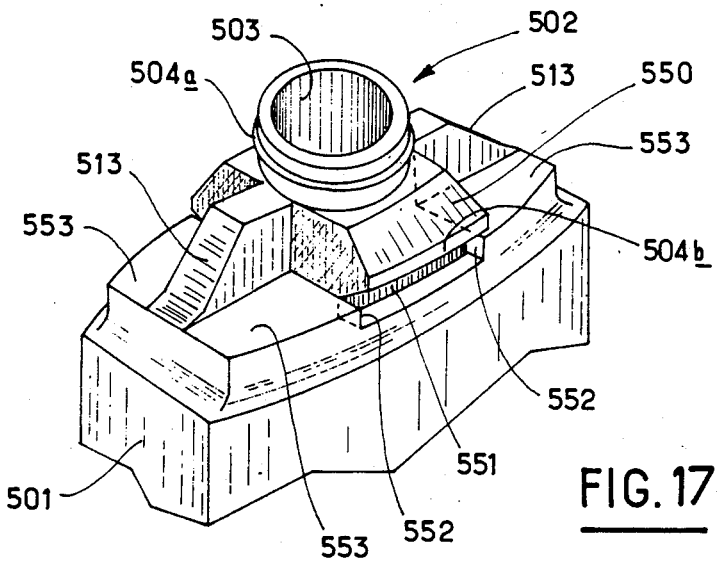
FIG. 17 is a perspective view of the upper portion of the container of FIG. 13.
Figure 19:
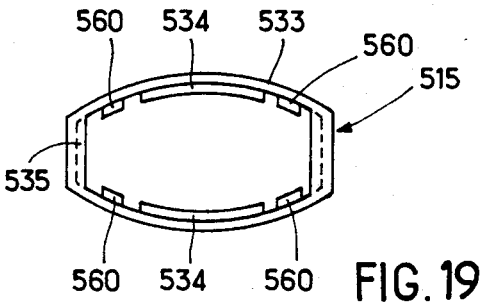
FIG. 19 is a view along line XIX—XIX of FIG. 18.
Figure 20:
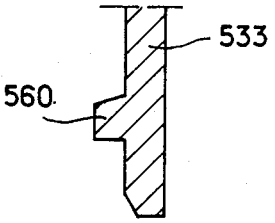
FIG. 20 is a view along line XX—XX of FIG. 18.
Figure 18:
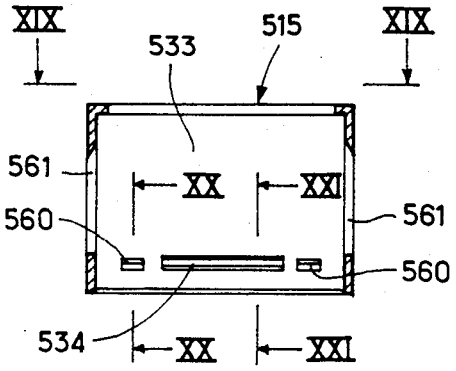
FIG. 18 is a cross-section of the outer cap alone, taken along the same cross-sectional plane as for FIG. 13.
Figure 21:
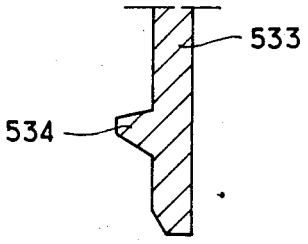
FIG. 21 is a view along line XXI—XXI of FIG. 18.
Figure 22:
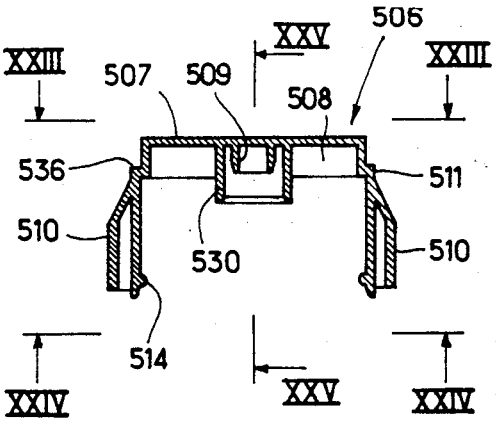
FIG. 22 is a cross-sectional view of the cap along the same cross-sectional plane as for FIG. 13.
Figure 23:
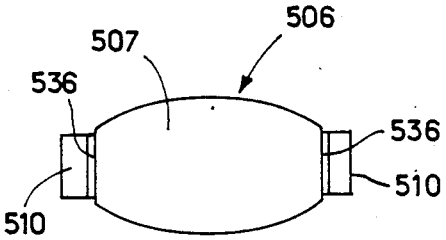
FIG. 23 is a view along line XXIII—XXIII of FIG. 22.
Figure 24:
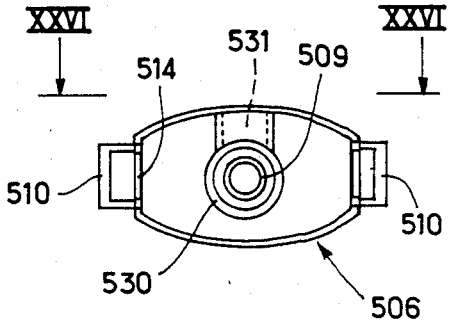
FIG. 24 is a view along line XXIV—XXIV of FIG. 22.
Figure 25:
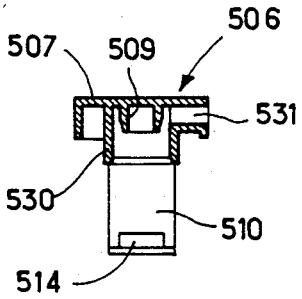
FIG. 25 is a view along line XXV—XXV of FIG. 22.
Figure 26:
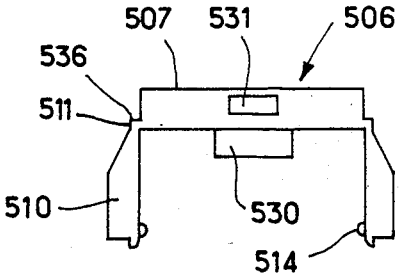
FIG. 26 is a view along line XXVI—XXVI of FIG. 24.
Figure 28:
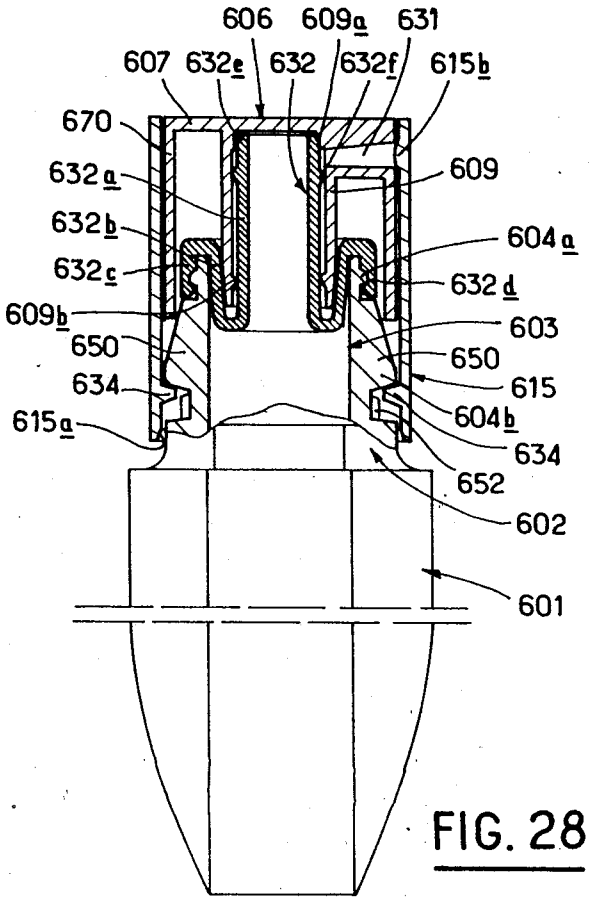
FIG. 28 is a cross-sectional view of the container of FIG. 27 along line XXVIII—XXVIII of FIG. 27.

A variant of this second embodiment is represented in FIGS. 11 and 12, where those elements corresponding to FIGS. 9 and 10 bear the same reference numerals increased by 100.

In this example of the embodiment, each pushing means is constituted by a tongue 410 integral at its axis of flexure 411 with a circular element 425. This circular element 425 is situated outside the cap 406: it is catch-engaged opposite the skirt 408 at the periphery of the top panel 407 of the cap 406 as represented in FIG. 11. A slot 429 is arranged in the lateral skirt 408 opposite each tongue 410 so as to allow the displacement of the tongue. The catches 428, situated at the free ends 412 of the tongues 410 facing the spout 403, cooperate with the annulus 418 through the openings 426 which are arranged at their level in the lateral skirt 408 in the extension of the slots 429. The method of operation is identical with that of the preceding embodiments. Just as in the preceding example, the fixing means comprised in the top panel 407 of the cap 406 is constituted by two tabs 413 each ending in a projeciton 414 cooperating with the fastening flange 404 situated on the spout 403.

It has been found that when the general shape of the container is an oval it is advantageous to dispose the tabs 13 along the same diameter as the tongues 10, that is to say, along the major diameter of the oval, as represented in FIG. 3. On the other hand, when the general shape of the container is a circular cylinder, it has been found advantageous to dispose these tabs along an axis substantially perpendicular to that of the tongues as represented in the other Figures.

If reference is now made to FIGS. 13 to 26, it will be seen that the container represented in accordance with a third embodiment of the present invention comprises, firstly a body 501 delimited by a wall, secondly a neck 502 surmounting this body 501 and comprising a substantially cylindrical spout 503, and thirdly a cap 506 which can be manipulated with one hand only, which is held in position on the spout 503 by means of a cover cap 515.

The body 501 has a substantially elliptical cross-section; the spout 503 is provided with a fastening flange 504*a* for fixing an adaptor 532 which extends the spout and has the shape of a perfectly cylindrical conduit carried by a base which comes to be catch engaged on the flange 504*a*. This adaptor 532 will be considered in the remaining part of the description as forming one part only with the spout 503 proper: this assembly will be designated as "spout 503" in the remaining part of the present description. The neck 502 carries a second fastening flange 504*b* for holding the cover cap 505 in position on the neck 502.

The cap 506 is constituted by a top panel 507 extended by a lateral skirt 508. The top panel 507 of cap 506 carries, on the inside of the cap, two coaxial cylindrical skirts intended to cooperate with the spout 503, namely an internal skirt 509 called the sealing skirt, and an external skirt 530 called the guidance skirt and disposed substantially along the external wall of the spout 503. The sealing skirt 509 is pushed down into the spout 503 so that the product contained in the body 501 should not escape when the cap 506 is in the closed position, that is to say pushed down on the spout 503. The external skirt 530 comprises in its upper portion a lateral opening which communicates with the outside via a duct 531 (FIG. 14) adjacent to the top panel 507 of the cap 506. The top panel 507 has a generally elliptical shape substantially corresponding to the cross-section of the body 501, and the duct 531 is oriented along the minor axis of the ellipse.

The cap 506 comprises in each of the end zones of the major axis of the ellipse constituted by the top panel 507, a pushing means constituted by a tab 510 flexibly joined to the base of the skirt 508: each of these tabs 510 is integral with the lateral skirt at the zone of its axis of flexure 511. The axis of flexure 511 is parallel to the top panel 507 and is situated at the base of the skirt 508. The end of the tab 510 which is remote from the axis of flexure 511 forms a free extension 512 situated directly below the axis of flexure 511. The ends of the tabs 510 carry inwardly of the cap a projection 514 intended to bear on an inclined plane forming a ramp 513 carried by the neck 502, symmetrically on either side of the spout 503. The axes of the ramps 513 are in the plane P defined by the axis of the spout 503 and by the major axis of the elliptical cross-section of the body 501. In the zones situated on either side of the spout 503 near the plane Q passing through the axis of the spout and perpendicular to P, the neck 502 comprises bosses 550 each delimited by a sector of an elliptical cone having its tip towards the top of the spout. At their bases, these bosses 550 comprise a groove 551 (FIG. 16) situated in a plane perpendicular to the axis of the spout 503; the upper edge of the groove 511 forms the second fastening flange 504*b*. The ends of the grooves 551 are closed in their lower portion by walls 552 and are open in their upper portion. The walls 552 form the edge of a bearing surface 553. The neck 502 thus comprises four surfaces 553 disposed symmetrically on either side of the ramps 513 and on either side of the bosses 550.

The cover cap 515 is constituted by a cylindrical skirt 533 whose cross-section is substantially elliptical so that its base can come to cooperate with the base of neck 502. The upper end of this skirt 533 is intended to surround the top panel 507 of the cap 506.

Near the ends of the major axis of the ellipse, the skirt of the cover cap 515 carries, along its upper edge, rims 535 intended to cooperate with the shoulders 536 carried by the cap 506 just above each one of its axes of flexure 511. At its base, the skirt 533 of the cover cap 515 carries two fastening catches 534 with a slightly shorter length than that of the grooves 551; these catches 534 are symmetrical with each other in relation to the cover cap axis and situated in a plane perpendicular to this axis; each catch 534 is moreover disposed symmetrically in relation to the axis plane passing through the minor axis of the ellipse in cross-section. On either side of each catch 534, there are disposed stops 560 which are in the same plane as the catches 534 and which come to bear on the surfaces 553 of the neck 502 when the cover cap 515 is positioned on the neck 502. Between two stops 560 not separated by a catch 534, the skirt 533 comprises openings 561 allowing the tabs 510 to pass.

The assembly of this unit is effected by first fixing the adaptor 532 on the neck 502; the cap 506 is then positioned, the upper portion of the conduit of the adaptor 532 becoming engaged between the two skirts 509 and 530: in this position, the projections 514 are disposed opposite the ramps 513. Finally, the cover cap 515 is put into place by causing the tabs 510 to pass into the openings 561; it then suffices to push down the cover cap 515 towards the body 501 to fix it on the container by catch-engagement of the catches 534 under the flange 504*b* defined by the grooves 551. It should be noted that the cap 506 is not fixed on the neck 502; it is displaceable in relation to the cover cap 515. It is, of course, necessary for the relative positions of the cover cap 515 and the cap 506 to be accurately fixed to allow the desired displacement of the two parts. This is why the depression of the cover cap 515 for its catch-engagement is limited by the stops 560 bearing on the surfaces 553 of the neck 502; in this position, the upper edge of the adaptor 532 is near the top panel 507, the projections 514 are in the immediate vicinity of the ramps 513 and the rim 535 are at a distance from the shoulders 536.

When one wishes to open such a container, that is to say to place the interior of this container into communication with the lateral duct 531, it suffices for the user to depress the tabs 510 with two fingers of the same hand; the projections 514 of the free ends 512 of these tabs 510 come into contact with the ramps 513.

The cap 506 is thus pushed upwards because of the slope of the ramps 513 and it is displaced in relation to the cover cap 515 until the shoulders 536 come to bear against the rims 535. Because of this, the lateral duct 531 is placed into communication with the container interior because the lateral opening of the skirt 530 is no longer obturated by the duct of the adaptor 532 and the skirt 509 is released from the spout 503: the user can thus take up the product contained in the container. According to this example of the embodiment, the means for retaining the cap 506 in the open position are thus constituted by the cover cap 515.

To close the container, that is to say, to replace the cap 506 in position, it suffices to force it down on the adaptor 532 until the top of the adaptor comes to bear against the top panel 507; the top panel 507 of the cap 506 is then substantially in the same plane as the rim 535 of the cover cap 515 and the device is thus returned to its original closed state.

As will have been observed, the cover cap 515 remains integral with the container and does not in any way impede the handling of the cap 506.

If reference is made to FIGS. 27 to 32, it will be seen that the container represented in accordance with a fourth embodiment of the invention comprises firstly a body 601 delimited by a wall, secondly, a neck 602 surmounting this body 601 and comprising a substantially cylindrical spout 603, and thirdly a cap 606, that can be manipulated with one hand only, which is held on the spout 603 in the closed position of the container 601 by means of a ring 615 which comprises actuating means for manipulating the cap 606.

The body 601 has a substantially elliptical cross-section; the spout 603 is provided with a fastening flange 604*a* for the fixing of an adaptor 632 which comprises a perfectly cylindrical conduit 632*a*, intended to be partly inserted in the axis of the spout 603, the lower edge of said duct 632*a* being folded on itself twice towards the outside to constitute an intermediate annular wall 632*b* and an external skirt 632*c*. In the fitted position of the adaptor 632 on the spout 603, the annular wall 632*b* comes against the internal upper wall of the spout 603 whose edge is received in the annular space between the wall 632*b* and the skirt 632*c* which comprises internally an annular groove 632*d* intended to receive the fastening flange 604*a*.

The neck 602 carries a second fastening flange 604*b* for holding the ring 615 in position on the neck 602.

The cap 606 is constituted by a top panel 607 extended in a lateral skirt 670. The top panel 607 of the cap 606 carries, inwardly of the cap, an axial cylindrical skirt 609 ensuring, at one and the same time the funcitons of sealing and guidance which had been ensured separately by the skirts 509 and 530 of the cap 506 of the embodiment described above. In fact, the skirt 609 is disposed substantially along the external wall of the duct 632*a* being received at its base in the annular space between the duct 632*a* and the wall 632*b*; it comprises internally, near its transition to the top panel 607, a frustoconical annular set back 609*a* intended to come to bear on the upper external bevelled edge 632*e* of the duct 632*a*, in the closed position of the container 601; the seal between the duct 632*a* and the cap, which is necessary in particular when the opening of the said container 601 is freed, is obtained by means of a peripheral bead 632*f* carried externally by the duct 632*a* in its upper region and being constantly in bearing contact against the internal wall of the skirt 609. The skirt also carries, near its free edge, an internal peripheral bead 609*b* which is also constantly in bearing contact against the external wall of the duct 632*a*. This bead 609*b*, coming to bear against the bead 632*f* on completion of the manipulation of the cap 606, also has the function of preventing complete extraction of the cap 606.

The skirt 609 also comprises, in its upper portion beneath the set-back 609*a*, a lateral opening which communicates towards the outside via a duct 631 adjacent to the top panel 607 of the cap 606. The top panel 607 has a generally elliptical shape substantially corresponding to the cross-section of the body 601 and the duct 631 is orientated along the minor axis of the ellipse and is directed to slope upwardly slightly.

The top panel 607 also has two extensions 608 having the shape of two strips with a rectangular cross-section whose median longitudinal plane is identical with the plane P defined by the axis of the spout 603 and by the major axis of the elliptical cross-section of the top panel 607, these extensions 608 coming to be placed on either side of the spout 603 in the assembled position of the cap 606. The two opposed external lateral walls of the extension 608 are sloping over a distance extending substantially from their midheight as far as the vicinity of their lower edge so as to constitute ramps 613 whose axes are in the above mentioned plane P.

Figure 30:
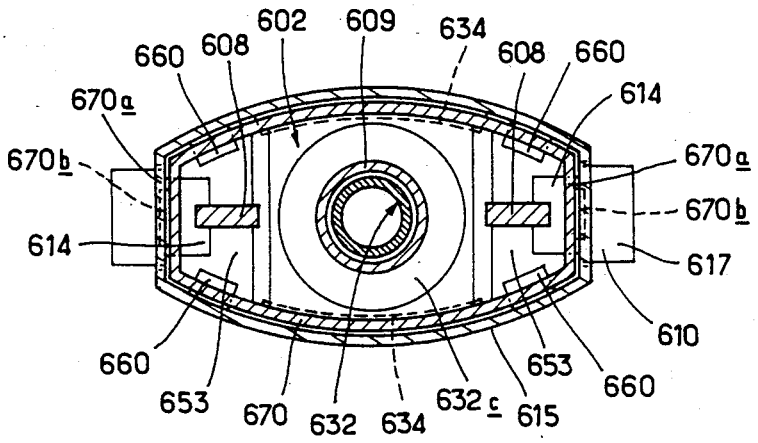
FIG. 30 is a transverse cross-sectional view taken along XXX—XXX of FIG. 27.

As may be seen in FIG. 30, the skirt 670 comprises, in each one of its end walls 670*a* which are situated opposite the extensions 608 and which are mutually parallel, a channel-shaped cut out 661, whose function will be indicated below. Above the upper edge delimiting each cut out 661 and parallel thereto, is a fastening catch 670*b* whose function will also be indicated below.

The sleeve 615 has a substantially elliptical cross-section so that its base can come to cooperate with the base of the neck 602. Its lower internal edge 615*a* is bevelled. In the assembled position, the free upper edge of the sleeve 615 comes to be level with the top panel 607 of the cap 606.

The sleeve 615 comprises, in each of the end zones of the major axis of the ellipse which it forms in cross-section pushing means 610 constituted by a tab cut out in the pushing means. The tabs 610 therefore remain integral with the sleeve 615 at the zone of their axis of flexure 611. The axes 611 are positioned in a plane perpendicular to the axis of the sleeve 615 in the lower region of said sleeve 615. The side of each tab 610 which is on the opposite side to the axis of flexure 611 forms a free end 612 situated above the axis of flexure 611. Inwardly of the cap, the tabs 610 have a projection 614 passing through the cut out 661 of the skirt 670 and intended to bear on the ramp 613 carried by the associated extension 608 of the cap 606.

The internal projection 614 does not extend quite as far as the upper edge of the tab 610 so that the upper portion of the tab comes to be opposite the zone of the skirt 670 situated between the upper edge delimiting the cut out 661 and the catch 670*b*. In the assembled position of the cap 606 on the sleeve 615 the catch becomes fastened under the above mentioned edge of the tab 610. Moreover, in the closed position of the container, the projection 614 comes to be opposite the upper region of the associated ramp 613. Moreover, over their whole surface the tabs 60 project outwardly of the sleeve 615 at extra thickness portions 617, which facilitate the manipulation of the opening of the container 601 by action on the tab 610, as will be described below.

In its region intended to be opposite the duct 631 the sleeve 615 also carries a hemispherical protruberance **615*b*, penetrating into the said duct 631 in the closed position of the container 601** to ensure a seal, if required.

The operation of fastening of the ring 615 on the container 601, which is substantially of the same type as for the embodiment described above will now be described.

In the zones to either side of the spout 603, near the plane Q, which passes through the axis of the said spout and is perpendicular to the plane P defined above, the neck 602 comprises bosses 650 each delimited by a sector of an elliptical cone having its tip nearer the top of the spout 603. At their bases, these bosses 650 comprise a groove 651 (FIG. 29) situated in a plane perpendicular to the axis of the spout 603; the upper edge of the groove 651 forms the second attachment flange **604*b*. The ends of the grooves 651 are closed in their lower portion by walls 652 and are open in their upper portion. The walls 652 form the edge of a bearing plate 653. The neck 602 thus comprises two bearing plates 653 disposed one on either side of the bosses 650**.

At its base, the sleeve 615 carries two fastening catches 634 having a length which is slightly shorter than the axial length of the grooves 651; these catches 634 are symmetrical with each other in relation to the axis of the sleeve 615 and are situated in a plane perpendicular to this axis; each catch 634 is, moreover, disposed symmetrically in relation to the axial plane passing through the major axis of the ellipse of cross-section. On either side of each catch 634, are stops 660 which are in the same plane as the catches 634 and which abut the bearing plates 653 of the neck 602 when the sleeve 615 is positioned on the neck 602. Between the two stops 660 which are not separated by a catch 634, the sleeve 615 comprises the openings 661 allowing the tabs 610 to pass.

Figure 27:
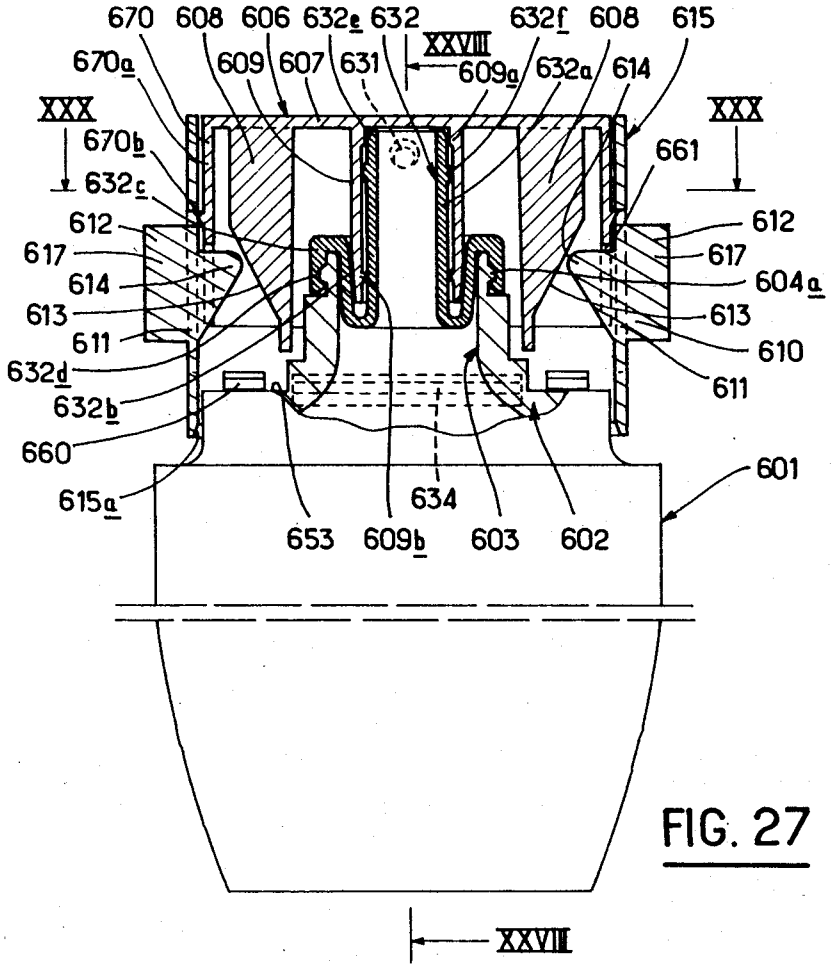
FIG. 27 is a cross-sectional view of a container in accordance with a fourth embodiment of the present invention, taken along the major axis of the ellipse of cross-section, the container being in the closed configuration.
Figure 29:
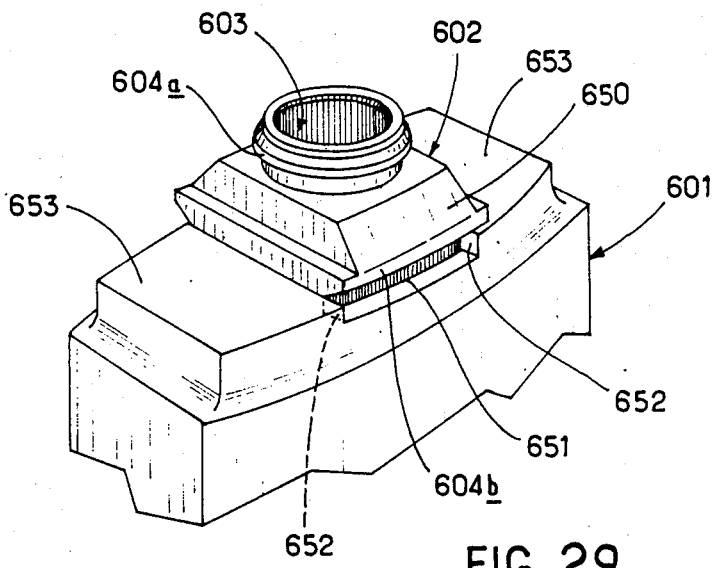
FIG. 29 is a perspective view of the upper portion of the container of FIG. 27.

The assembly of this fourth embodiment is effected by first fixing the adaptor 632 on the neck 602; the sleeve 615 is then positioned on the body 601 and fixed on the container by catch engagement of the catches 634 under the flanges **604*b* defined by the grooves 651. Subsequently, the cap 606 is placed in position, with its skirt 609 engaged in the annular space comprised between the conduit 632*a* and the annular wall 632*b* surrounding the said conduit. The cap 606 is pushed down until the catches 670*b* come to be fastened on the sleeve 615, as represented in FIG. 27. It should be noted that the cap 606 is not fixed on the neck 602; it is displaceable in relation to the sleeve 615. Of course, it is necessary for the relative positions of the sleeve 615 and the cap 606 to be accurately fixed to allow the desired displacement of the two parts. This is why, as in the preceding embodiment, the depression of the sleeve 615 for its catch-engagement is limited by the abutting of the stops 660 on the surfaces 653 of the neck 602. In the above mentioned position, the upper edge of the adaptor 632 is near the top panel 607, the projections 614 are in the immediate vicinity of the upper regions of the ramps 613, and the bead 609*b* is spaced from the bead 632*f***.

Figure 31:
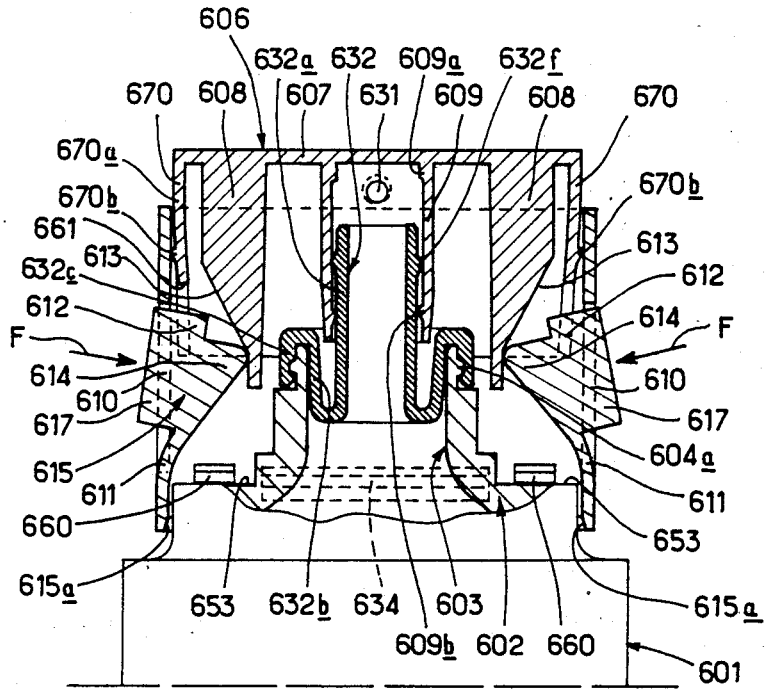
FIGS. 31 and 32 are views similar to the upper portions of FIGS. 27 and 28 respectively, in the position where the opening is freed.
Figure 32:
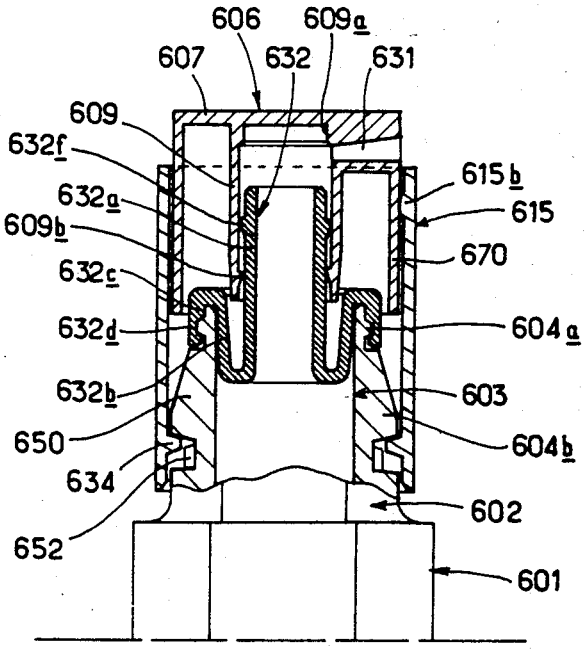

When such a container is to be opened, that is to say the interior of this container is to be placed in communication with the lateral duct 631, it suffices for the user to depress the tabs 610 with two fingers of one and the same hand as is symbolically indicated by the arrows F in FIG. 31; the projections 614 of these tabs come into contact with the ramps 613.

The cap 606 is thus pushed upwards because of the inclination of the ramps 613 after the catches **670*b* have been released from the corresponding edge of the sleeve 615 and it can be displaced in relation to the sleeve 615 until the bead 609*b* comes to bear against the bead 632*f*. Because of this, the lateral duct 631 is placed in communication with the outside of the container, because the lateral opening of the skirt 609 is no longer concealed by the side wall of the conduit of the adaptor 632 and the skirt 609 is released from the spout 603**: the user can thus take up the product contained in the container.

To close the container, that is to say, to replace the cap 606 in position, it sufficies to push it down against the adaptor 632 until the top of the adaptor comes to bear against the top panel 607; the top panel 607 of the cap 606 is then substantially in the same plane as the upper edge of the sleeve 615 and the device is thus returned to its original state.

It shall be duly understood that the embodiments which have been described above have been given by way of an indication and that modifications can be introduced without thereby departing from the scope of the present invention as defined by the following claims.

I claim:

1. A container comprising:

(a) a body delimited by a wall;

(b) a substantially cylindrical spout on said container;

(c) a neck surmounting said body and terminating in said substantially cylindrical spout;

(d) at least one fastening flange means carried by said neck;

(e) a cap adapted to be manipulated with only one hand, said cap comprising a top panel and a side extension to said top panel; and (f) means for retaining the cap on the container, said means comprising fixing means cooperating with the fastening flange means on said neck; wherein (g) cooperating first and second means, carried respectively by said side extension and said cap retaining means, are effective to insure displacement of the cap relative to the neck and hence opening of the container, one of said cooperating first and second means comprising a pair of pushing means accessible from outside the cap and arranged substantially symmetrically relative to the spout, said pushing means, when actuated, being displaceable relative to an axis of flexure which is substantially parallel to said top panel of said cap, the other of said cooperating first and second means comprising inclined ramp means serving as bearing surfaces for said pushing means when the pushing means are actuated and wherein;

said retaining means comprises an element surrounding the cap, said element having a wall to which the pushing means are joined; the top panel of said cap supporting sealing means adapted to slide along a wall of said spout 1; and means defining an opening in said sealing means, said opening being adapted to be closed by the wall of the spout when the cap is in a closed position, and said opening being separated from said wall by translational movement of the cap when the pushing means are actuated so as to communicate said spout with a lateral duct in the cap for the ejection of a product contained in the container.

2. The container as claimed in claim 1 wherein the inclined ramp means comprises two inclined ramps each associated with a respective one of the pushing means, said ramps being formed in said side extension associated with the top panel of the cap.

3. The container as claimed in claim 1 wherein each of said pushing means comprises a flexible tab attached to an element of the cap with which it is integrally joined at the axis of flexure, the end of said tab remote from said axis of flexure constituting a free end, said ramps being located to cooperate with said free ends of said tabs.

4. The container as claimed in claim 1 wherein said ramps are inclined planes.

5. The container as claimed in claim 1 wherein said sealing means comprises first and second coaxial skirts, said first skirt being disposd substantially against an internal wall of the spout, and said second skirt being supported by the cap and disposed substantially along an external wall of the first skirt, said second skirt containing the opening which is joined to the lateral duct when the pushing means are actuated.

6. A container according to claim 1, including an adaptor fastened to said spout and having a conduit coaxial therewith; the sealing means including an axial skirt containing the opening which is joined to the lateral duct when the pushing means are actuated, said conduit having a free edge twice folded back on itself to form an intermediate annular zone for receiving the said axial skirt and an external annular zone for fastening to the spout.

7. A container according to claim 6, wherein the lateral duct is located adjacent to the top panel of the cap.

8. A container according to claim 6, including means for limiting the travel of the cap relative to the container in the direction of opening the container.

9. A container according to claim 6, wherein said container has a substantially elliptical cross-section.

10. A container according to claim 9, wherein said pushing means and ramps are disposed substantially opposite the ends of the major axis of the ellipse; and wherein the fixing means for retaining the cap on the retainer are substantially opposite the ends of the minor axis of the said ellipse.

11. A container according to claim 6, wherein the element of said cap retaining means comprises, in the vicinity of the fixing means and on either side thereof, stops which bear on surfaces on the neck.

* * * * *